US007819482B2

(12) United States Patent
Liviero et al.

(10) Patent No.: US 7,819,482 B2
(45) Date of Patent: Oct. 26, 2010

(54) ARMREST/BACKREST SUPPORT BRACKET FOR CHAIRS, IN PARTICULAR OFFICE CHAIRS

(75) Inventors: Stefano Liviero, Rossano Veneto (IT); Claudio Gorgi, Resana (IT)

(73) Assignee: Imarc S.p.A., Rossano Veneto (IT)

( * ) Notice: Subject to any disclaimer, the term of this patent is extended or adjusted under 35 U.S.C. 154(b) by 0 days.

(21) Appl. No.: 11/597,418

(22) PCT Filed: May 18, 2005

(86) PCT No.: PCT/EP2005/005370

§ 371 (c)(1),
(2), (4) Date: Nov. 22, 2006

(87) PCT Pub. No.: WO2005/117650

PCT Pub. Date: Dec. 15, 2005

(65) Prior Publication Data

US 2008/0048480 A1 Feb. 28, 2008

(30) Foreign Application Priority Data

May 26, 2004 (IT) ..... VE2004U0012

(51) Int. Cl.
*A47C 7/54* (2006.01)
*B60N 2/46* (2006.01)

(52) U.S. Cl. ..... 297/411.26; 297/411.36

(58) Field of Classification Search ..... 297/411.26, 297/411.27, 411.37, 440.1, 411.36
See application file for complete search history.

(56) References Cited

U.S. PATENT DOCUMENTS 4,815,688 A * 3/1989 Wood ..... 248/230.2
4,913,393 A * 4/1990 Wood ..... 248/230.2
5,335,782 A * 8/1994 Herzog ..... 198/836.3
5,445,434 A * 8/1995 Kohut ..... 297/391
5,484,187 A * 1/1996 Doerner et al. ..... 297/411.3
5,536,068 A * 7/1996 Valentor et al. ..... 297/344.18
5,653,499 A * 8/1997 Goodall ..... 297/170
5,797,655 A * 8/1998 Miles ..... 297/411.23
5,876,097 A * 3/1999 Cao ..... 297/411.37
6,070,941 A * 6/2000 Chung ..... 297/440.16
6,142,570 A * 11/2000 Bergsten et al. ..... 297/411.35
D438,725 S * 3/2001 Takahashi ..... D6/418
6,336,680 B1 * 1/2002 Lee ..... 297/411.36
6,398,309 B1 * 6/2002 Chen ..... 297/411.36
6,554,234 B2 * 4/2003 Holdren ..... 248/118.5
6,634,826 B1 * 10/2003 Marsetti ..... 403/325
6,773,071 B1 * 8/2004 Stasney et al. ..... 297/411.27
6,811,224 B2 * 11/2004 Roney et al. ..... 297/411.35

(Continued)

FOREIGN PATENT DOCUMENTS

DE 203 12 711 11/2003

(Continued)

*Primary Examiner*—David Dunn
*Assistant Examiner*—Philip Gabler
(74) *Attorney, Agent, or Firm*—Stein McEwen, LLP

(57) ABSTRACT

An armrest/backrest support bracket characterised by comprising: a support (4) provided in its lateral surface with a slot (14) and in its end surface with a hole which communicates with said slot, a blade (6) one end of which is insertable into said slot, locking means inserted into said hole and interacting with said support and with that blade part (6) housed in the slot.

2 Claims, 4 Drawing Sheets

U.S. PATENT DOCUMENTS

| | | | | |
|---|---|---|---|---|
| 6,824,217 | B1 * | 11/2004 | Wang | 297/411.36 |
| 6,837,545 | B1 * | 1/2005 | Ho | 297/411.36 |
| 6,957,867 | B1 * | 10/2005 | Su | 297/411.36 |
| 6,974,189 | B2 * | 12/2005 | Machael et al. | 297/411.36 |
| 7,137,351 | B2 * | 11/2006 | Picou | 114/363 |
| 7,413,159 | B2 * | 8/2008 | Liang et al. | 248/676 |
| 7,429,084 | B2 * | 9/2008 | Diedrich | 297/440.16 |
| 2006/0208552 | A1 * | 9/2006 | Nishiwaki | 297/411.37 |
| 2007/0063112 | A1 * | 3/2007 | Patterson | 248/188.6 |

FOREIGN PATENT DOCUMENTS

| | | |
|---|---|---|
| EP | 958765 | 11/1999 |
| EP | 1258209 | 11/2002 |

* cited by examiner

FIG. 1
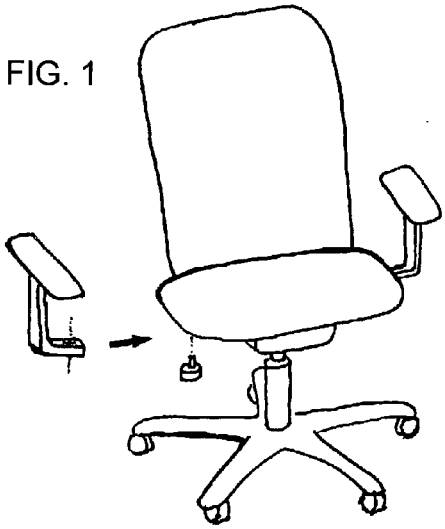
FIG. 4
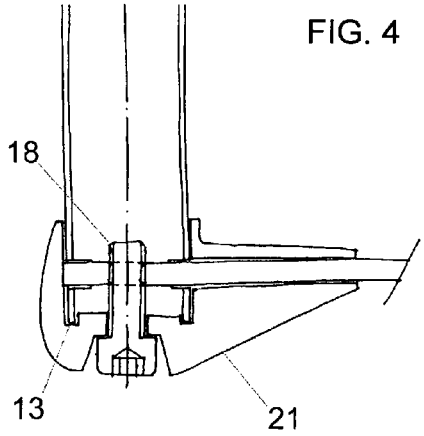
FIG. 6
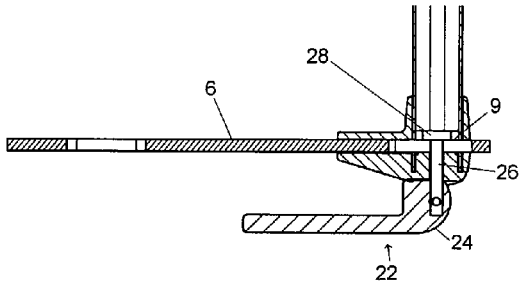
FIG. 5
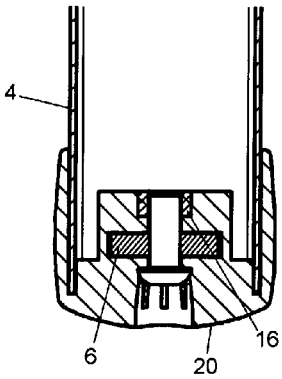
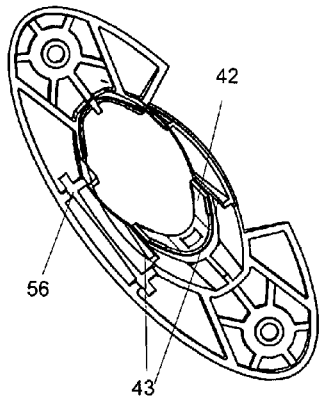
FIG. 10

ARMREST/BACKREST SUPPORT BRACKET FOR CHAIRS, IN PARTICULAR OFFICE CHAIRS

The present invention relates to a armrest/backrest support bracket for chairs, in particular office chairs.

BACKGROUND OF THE INVENTION

Support brackets for chair armrests or backrests are known, consisting of an upper part or pad on which the arm or back of the chair user rests, a vertical support and a horizontal blade for its fixing to the chair frame.

These brackets however present the drawback of lack of flexibility and modularity.

In this respect, seeing the large variety of chairs and applications, it is important that these armrest and backrest brackets can be modified in terms of their main dimensions.

The known art often uses plastic or aluminium parts obtained by injection moulding, which by their very nature are very rigid in adapting to the individual person.

To obviate these drawbacks, brackets have been proposed consisting of separate vertical support elements and horizontal fixing elements welded together.

This arrangement only partly solves the problems as the parts produced in this manner are in any event bulky and rigid when the parts are combined. They also present considerable aesthetic problems which can be solved only by applying coverings on the weld region and by costly cleaning operations.

Another proposed arrangement consists of a single bent blade which performs both the bracket and support function. This arrangement however presents evident limits in terms of bulk, appearance and modularity.

Another proposed arrangement is to fix the blade to a tubular support element by screwing it onto a bush welded inside the tubular element.

This arrangement has the drawback of substantial cost due to welding and to the use of a relatively costly element such as the lathe-turned bush.

Moreover it does not enable the blade to be reliably orientated relative to the support, so that semi-permanent screwing operations have to be carried out in the factory (with the same drawbacks as the other arrangements) or further manufacturing costs have to be incurred by using insertion fitting between the parts.

Brackets are also known which enable the height of the arm/back support to be adjusted by the use of telescopic elements.

These known brackets present however certain drawbacks and in particular:

- slackness and jamming while sliding,
- complicated construction,
- a large number of components leading to high cost and possible reliability problems,
- non-ergonomic adjustments.

With regard to the problem of sliding the telescopic elements within height-adjustable brackets, the known art has already proposed different solutions.

The most frequent solution, in which the sleeve is rigid with the arm/back support and slides directly on the surface of the vertical support element (tubular or blade) presents the drawback of unacceptable slackness as it is difficult to achieve a constructional precision which eliminates gaps within the guide regions.

Another drawback consists of the fact that the sliding between the constituent rigid material of the sleeve (typically polyamide filled with glass fibre) and the outer surface of the tubular element determines continuous rubbing leading to surface deterioration.

To solve this problem brackets have been proposed in which the tube slides internally via an additional guide while the outer sleeve has only an aesthetic function. Again in this case the addition of another important element leads to additional costs and does not fully solve the problem of sliding precision because of the aforesaid known problems.

In other cases use is made of bands of self-lubricating material rigid with one of the telescopic elements, which improve sliding without ruining the outer surface. However to apply these bands and maintain them in position, costly arrangements have to be used comprising seats obtained by rectifying machining or fixtures with movements to obtain undercuts, or open half-shells which once assembled enclose one of the telescopic elements.

The known art presents various solutions for locking the movement of the telescopic elements of the brackets.

In some cases controls are provided connected to a transmission which by means of a cam disengages a catch from the holes provided in the other telescopic element.

These solutions present the drawback of being complicated in terms of the large number of parts and of the difficulty and time of assembly.

Other simpler solutions exist comprising a control, usually a pushbutton, connected directly to the catch. However this penalizes the ergonomics of the bracket as the position of the control and the type of control movement are uncomfortable, not immediate and unnatural.

BRIEF SUMMARY OF THE INVENTION

According to the invention all these drawbacks are eliminated by an armrest/backrest support bracket as claimed in claim 1.

The present invention is described in detail hereinafter with reference to the accompanying drawings, in which:

FIG. 1 is a perspective view of a chair provided with the bracket,

FIGS. 4-6 show different connection systems for locking the blade to the tubular support, FIG. 10 shows the connection of the sleeve shoes.

DETAILED DESCRIPTION

Figure 2:
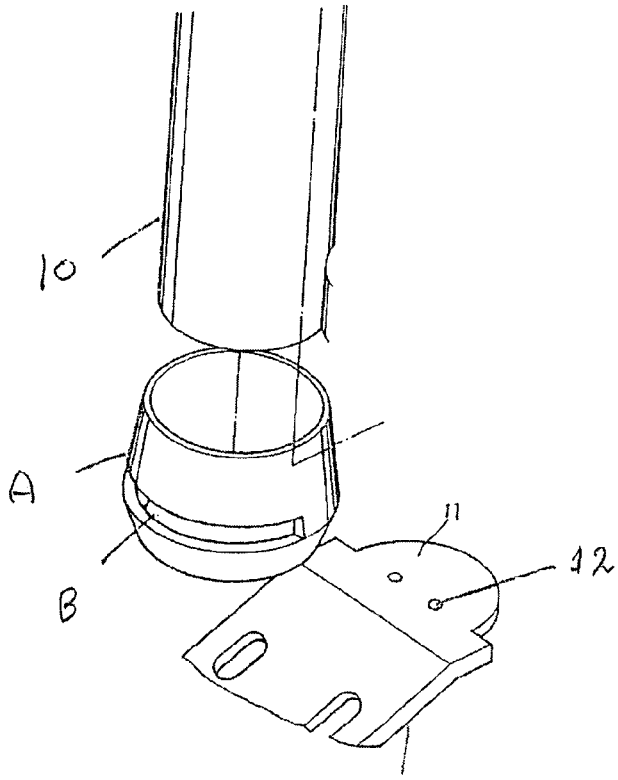
FIG. 2 is an exploded perspective view of a bracket.

As can be seen from the figures, the support bracket according to the invention comprises substantially a horizontal support 2 rigid with a tubular support 4, a blade 6 with threaded hole 8 and a knob 10 provided with a threaded pin 12 and a pressing surface 13.

A through slot 14 is provided in the tubular support 4.

To assemble the bracket of the invention, the blade 6 is inserted into the slot 14, after which the threaded pin is inserted from the support base to engage in the hole 8. When the knob has been screwed in, its surface 13 presses against the end of the support.

Figure 3:
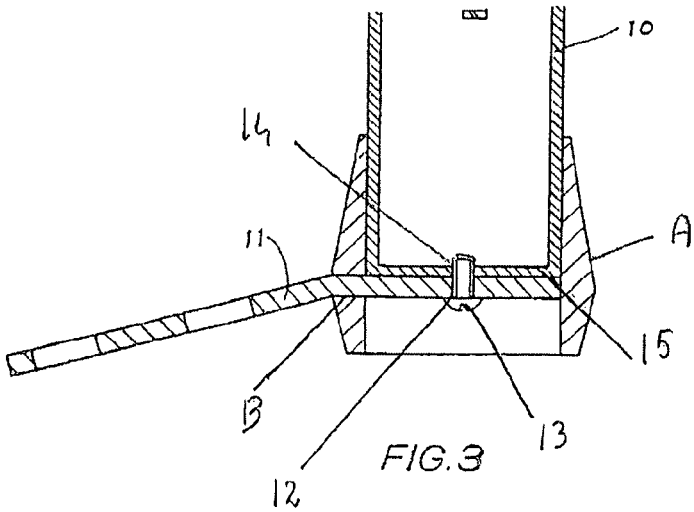
FIG. 3 shows it in its assembled configuration.

In the different embodiment of the bracket shown in FIG. 4, a screw 18 and cap 21 are used to achieve pressing against the tubular support and tightening of the bracket, in contrast to the embodiment of FIGS. 3 and 3 in which these functions are performed by the knob 10.

In the embodiment shown in FIG. 5 the cap 20 is provided internally with a threaded nut 16 in which a screw 18 engages after passing through the (no longer threaded) hole 8 of the blade 6.

In the embodiment shown in FIG. 6 the fixing element consists of a lever 22 with an eccentric head 24 to which there is pivoted a tie bar 26 which passes through an elongate hole 9 provided in the blade 6 and is provided at its other end with a counteracting plate 28.

In this embodiment, rotation of the lever 22 locks the blade within the slot and enables the position of the support element to be modified relative to the bracket.

Figure 7:
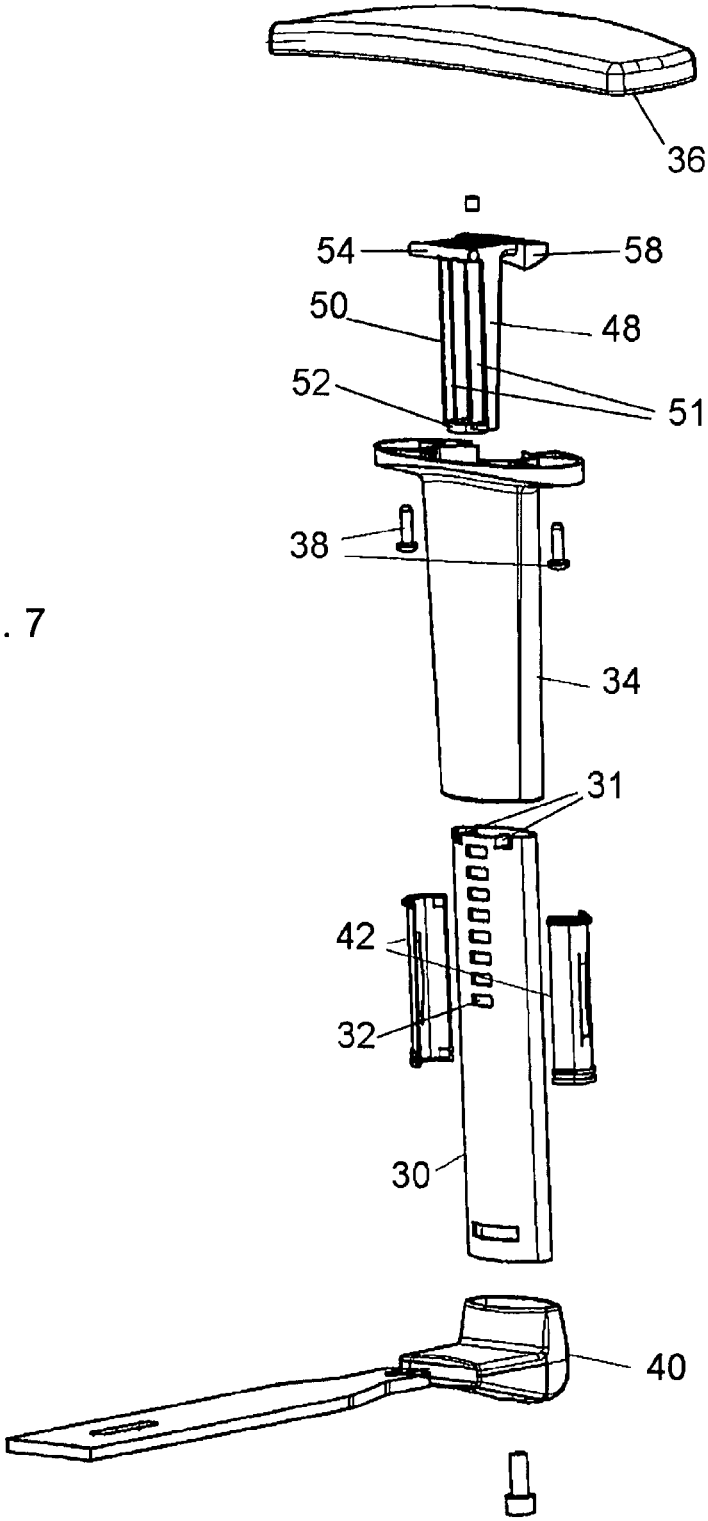
FIG. 7 is an exploded perspective view of an adjustable bracket.
Figure 9:
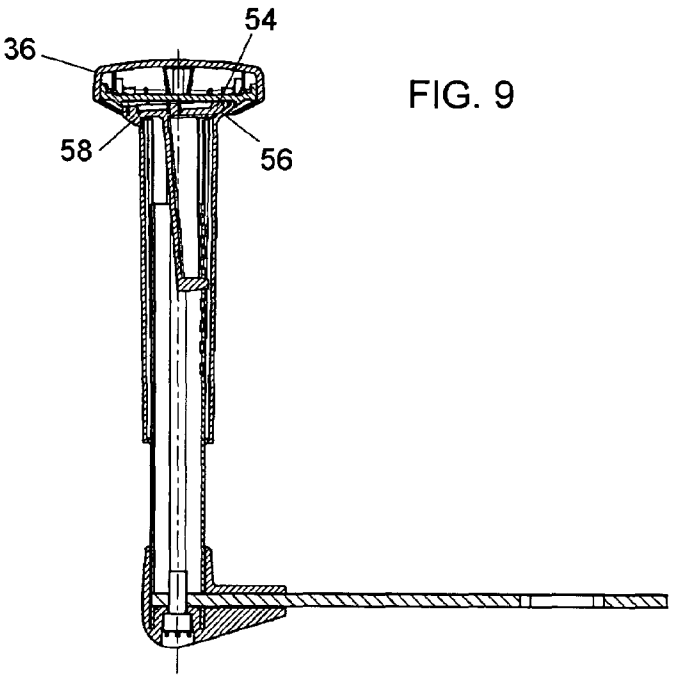
FIG. 9 is a longitudinal section therethrough.
Figure 8:
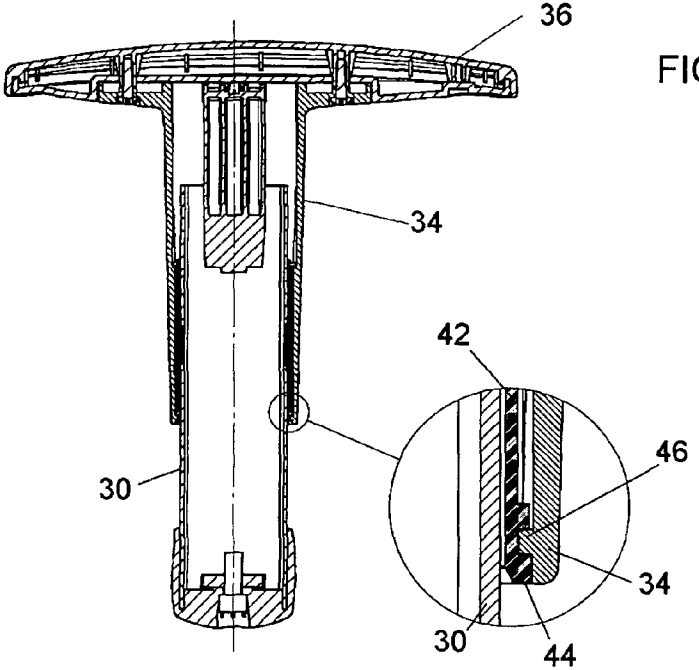
FIG. 8 is a cross-section therethrough.

FIGS. 7-9 show a height-adjustable armrest. Said armrest comprises a metal tubular element 30, a wall of which comprises a plurality of overlying holes 32 and two inwardly facing lugs 31. This tubular element is inserted into a plastic sleeve 34 rigidly fixed to the arm support 36 by screws 38.

The lower end of the tubular element 30 is inserted into a cap 40 into which the end of the blade 6 is also inserted by the already described systems, between the tubular element 30 and the sleeve 34 there being interposed two shoes 42 of self-lubricating material.

The shoes 42 perform various functions. They firstly prevent the hard plastic of the sleeve from directly contacting the tube surface, so ruining it during movement. They also enable very controlled sliding free from jamming by virtue of the self-lubricating properties of the material. At the points of contact with the internal tube they also present arch-shaped raised portions which by flexing, enable any slackness to be deadened, so compensating the connection inaccuracies of the telescopic elements.

Said shoes are provided with annular recesses 44 in which there engage corresponding ribs 46 provided in each sleeve, so making them rigid with it. Once the inner tube has been inserted into the outer sleeve, the shoes are compelled to remain in position. To facilitate assembly, vertical edges 43 are provided within the sleeve to retain the shoes before insertion of the tube (FIG. 10).

The armrest also comprises a substantially T-shaped locking element 48. The vertical portion 50 presents channels 51 in which the two lugs 31 engage to limit the stroke of the telescopic elements. The lower end of the vertical portion 50 is provided with a tooth 52 selectively engagable in one of the holes 32 of the tubular support 30. This locking element 48 also has an end 54 of a horizontal portion housed in a seat 56 provided on the top of the sleeve and retained by the arm support element 36. This end 54 acts as a hinge for the lever formed by the locking element, which also comprises a spring urging the tooth 52 into engagement with the holes.

The tooth 52 can be disengaged from the hole 32 by operating the other portion 58 of the element 48, to enable the sleeve to slide relative to the support.

For ergonomic reasons the pushbutton is positioned immediately below and to the side of the arm support element 36 and moves vertically, i.e. the same adjustment direction as the telescopic elements of the armrest.

From the aforegoing it is apparent that the bracket of the invention presents numerous advantages, and in particular:

- it is of completely modular construction adaptable to the individual person in that by modifying the height of the tubular element and changing the shape and dimensions of the blade, the depth, height and inclination of the bracket can be modified, including at the moment of final assembly,
- it enables very controlled sliding without slackness,
- it presents extreme constructional simplicity, resulting in product economy and reliability,
- it is highly ergonomic as adjustment is particularly simple and intuitive for the chair user, because of the position and movement of the release control,
- it presents substantial robustness to resist stresses during use and during the regulatory tests on the chair, by virtue of the fixing of the bracket element on the vertical tubular support element, which occurs directly by iron/iron contact within the appropriate slot of the tubular element.

The invention claimed is:

1. An armrest/backrest support bracket comprising:

a) an integral tubular support having an upper end and a lower end, b) a horizontal support joined to said upper end of said tubular support, c) the lower end of said tubular support being open, d) slots being formed clear through diametrically opposed surfaces on said tubular support, e) a blade extending through said slots in said tubular support, f) an aperture extending through said blade, said aperture having threads defined therein, g) locking means for securing said blade to said tubular support, h) said locking means comprising a cylindrical head with a threaded shaft extending axially therefrom, said cylindrical head having a diameter greater than the diameter of said tubular support, and, i) said locking means extending into said open end of said tubular housing so that said threaded shaft cooperates with the aperture in said blade to lock said blade in fixed position within said slots in said tubular housing, k) when said cylindrical head is drawn upwardly to abut the lower, open end of said tubular support by the advancement of said threads on said threaded shaft relative to said threads in said aperture in said blade wherein said threaded shaft solely engages said blade.

2. The armrest/backrest support as defined in claim 1 wherein said cylindrical head having an upper surface and a lower surface, and said upper surface of said cylindrical head is drawn upwardly against the lower end of said support when said threaded shaft is advanced through said threaded aperture in said blade.

* * * * *